US005765257A

United States Patent [19]

Steger et al.

[11] Patent Number: 5,765,257

[45] Date of Patent: Jun. 16, 1998

[54] MUFFLER

[75] Inventors: Christopher J. Steger, O'Fallon; David R. Hult; Jeffrey L. Young, both of St. Peters, all of Mo.

[73] Assignee: Emerson Electric Co., St. Louis, Mo.

[21] Appl. No.: 690,003

[22] Filed: Aug. 1, 1996

[51] Int. Cl.[6] ..... A47L 9/00

[52] U.S. Cl. ..... 15/326; 55/276; 181/256

[58] Field of Search ..... 15/326; 55/376; 181/256, 264

[56] References Cited

U.S. PATENT DOCUMENTS

| | | | |
|---|---|---|---|
| 3,971,096 | 7/1976 | Renholt | 15/326 |
| 4,015,683 | 4/1977 | Williams . | |
| 4,120,616 | 10/1978 | Dwyer et al. . | |
| 4,195,969 | 4/1980 | Whitney . | |
| 4,280,245 | 7/1981 | Hiester . | |
| 4,356,591 | 11/1982 | Lude . | |
| 4,418,443 | 12/1983 | Fischer . | |
| 4,435,877 | 3/1984 | Berfield | 15/326 |
| 4,665,581 | 5/1987 | Oberdorfer | 15/326 |
| 4,970,753 | 11/1990 | Herron . | |

*Primary Examiner*—Chris K. Moore

*Attorney, Agent, or Firm*—Polster, Lieder, Woodruff & Lucchesi

[57] ABSTRACT

An improved muffler for vacuum cleaners and other product applications is disclosed. The muffler includes a muffler body or enlarged head with a smaller hollow shaft extending from an open end of the muffler body or enlarged head for attachment to an exhaust of a vacuum cleaner or other application. The smaller hollow shaft terminates short of a transverse end wall of the muffler body. The transverse end wall may be constructed as a separate cover element. A noise dampening element is positioned adjacent the transverse end wall and also along an inner circumferential wall of the muffler body in order to dampen noise transmitted from the vacuum cleaner exhaust that passes through the smaller hollow shaft into the muffler body for absorption by the noise dampening element prior to being diverted by the transverse end wall in an opposite direction through the open end of the muffler body.

15 Claims, 3 Drawing Sheets

MUFFLER

BACKGROUND OF THE INVENTION

The present invention relates to an improved muffler, and more specifically, to an improved muffler designed for vacuum cleaners and other products that absorbs or dampens while also diverting noise emanating from an exhaust of the vacuum cleaner or other application.

Mufflers are typically used in automobiles, lawn mowers, and in other gasoline or diesel engine products to reduce the amount of noise emanating from the motor. On the other hand, mufflers have not been typically used for vacuum cleaners, although the noise emanating from vacuum cleaners, particularly wet/dry utility vacuum cleaners, is loud enough to justify the use of a muffler device. Noise levels from electric motor operated vacuum cleaners are objectionable due to the vibrations of the motor and blower fan as well as air moving at high speed through the vacuum cleaner. Yet, improved mufflers have not been widely used. Several different approaches have been tried, no single design has been widely adopted.

There are several different types of improved muffler or noise dampening systems that have been developed. In some cases, improved mufflers or noise reducing devices have been incorporated within the vacuum cleaner itself such as shown in U.S. Pat. Nos. 4,195,969; 4,418,443, and 4,970,753. In other cases, the housing itself or associated insulating devices have produced noise dampening sound domes such as disclosed in U.S. Pat. Nos. 4,280,245 and 4,356,591. There have even been attempts to develop improved quiet operating electric motors and blowers such as disclosed in U.S. Pat. No. 4,120,616. Of course, typical exhaust mounted mufflers or noise suppressing devices have also been developed for vacuum cleaners such as that disclosed in U.S. Pat. No. 4,015,683.

The improved muffler of the present invention is constructed to be used directly with a vacuum cleaner's exhaust port, either as a separate vacuum cleaner accessory or as an integral attachment. The improved muffler is constructed to significantly decrease a vacuum cleaner's noise level with a resulting increase in a user's comfort level. Additionally, the decrease in the vacuum cleaner's noise level does not measurably decrease the vacuum cleaner's performance. As will be understood, the muffler of the present invention can also be used for other applications, if desired.

SUMMARY OF THE INVENTION

Among the several objects and advantages of the present invention include:

- The provision of a new and improved muffler for vacuum cleaners and other products;
- The provision of a new and improved muffler which substantially reduces noise levels of the vacuum cleaner;
- The provision of a new and improved muffler which both reduces noise and does not detract from the performance and efficiency of the vacuum cleaner;
- The provision of a new and improved muffler which can be used in different sizes and types of vacuum cleaners;
- The provision of a new and improved muffler which is simple and economical in construction; made of a minimum number of parts; is readily adapted for attachment to a vacuum cleaner exhaust; can be incorporated as part of the vacuum cleaner if desired; and is otherwise well adapted for the purposes intended.

Briefly stated, the improved muffler of the present invention includes a muffler body having an enlarged head with a transverse end wall at one end at an opposite open end. The muffler body is connected to an inner end of a smaller hollow shaft which extends within the open end of the muffler body and terminates short of the transverse end wall. The smaller hollow shaft has an outer end which extends outside of the muffler body for attachment and/or association relative to a vacuum cleaner exhaust. A noise dampening element is positioned within the muffler body adjacent the transverse end wall such that noise transmitted from the vacuum cleaner exhaust passes through the smaller hollow shaft into the muffler body for absorption by the noise dampening element prior to being diverted by the transverse end wall in an opposite direction through the open end of the muffler body.

The smaller hollow shaft is preferably integrally connected to the muffler body through interconnecting radially extending fins.

The transverse end wall preferably is a separate cover that is releasably attached to the muffler body.

The noise dampening element preferably extends both adjacent the transverse end wall and along an inner circumferential wall of the muffler body. The noise dampening element is constructed to be trapped between the separate cover and the muffler body. The noise dampening element also includes slits for receiving the radially extending fins that integrally interconnect the smaller hollow shaft to the muffler body.

The noise dampening element is preferably constructed as a foam plastic material. One such foam plastic material is open cell polyester polyurethane foam material.

The noise dampening element adjacent the transverse end wall and the inner circumferential wall of the muffler body are preferably interconnected as a one piece element.

The separate cover in the muffler body include complementary fastening elements for securing same together.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

Figure 1:
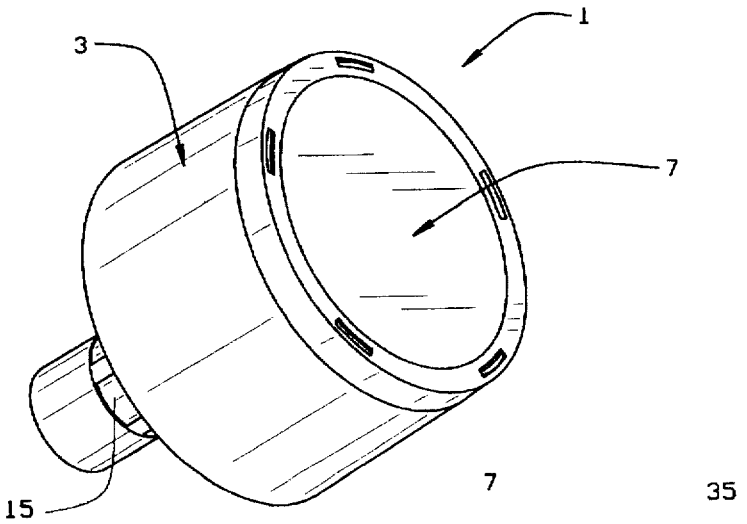
FIG. 1 is a perspective view of the improved muffler of the present invention.

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

In the discussion that follows, the muffler of the present invention will be described as a vacuum cleaner muffler although it will be understood that the muffler could be used in other product applications, as may be desired.

The improved muffler 1 of the present invention includes a muffler body 3, a noise adapting element 5 and a separate cover 7. As illustrated in the drawings, the noise dampening element 5 is received within the muffler body 3 and the separate cover 7 is then assembled relative to the muffler body for trapping or holding the noise dampening element 5 within the muffler body 3.

Figure 4:
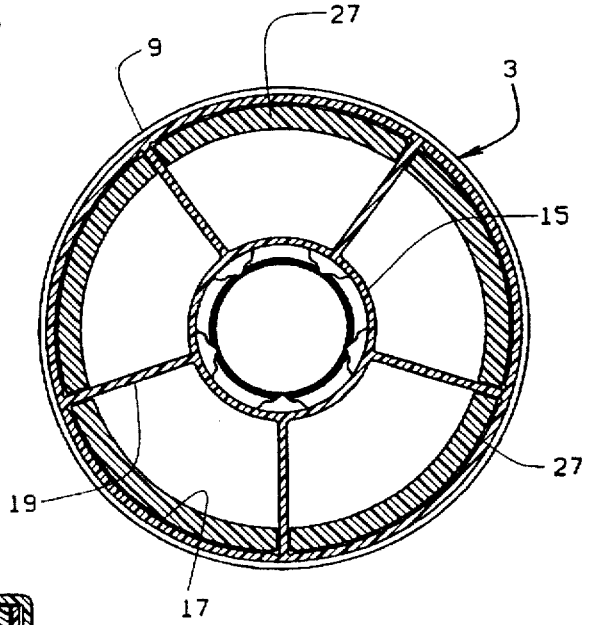
FIG. 4 is a sectional view of the improved muffler as viewed along lines 4—4 of FIG. 3.

The muffler body 3 includes a hollow cylindrical section or enlarged head 9 with open opposite ends 11, 13. A smaller hollow shaft 15 extends within one open end 11 of the hollow cylindrical section 9 and is integrally connected to an inner circumferential wall 15 of the hollow cylindrical section 9 through a series of radially extending fins 19. As best illustrated in FIG. 4 of the drawings, there are 5 radially extending fins 19 integrally joining the smaller hollow shaft to the inner circumferential wall 19 of the hollow cylindrical section 9. The smaller hollow shaft 15 has an outer end 21 which extends outside of the muffler body 3 for attachment to a vacuum cleaner exhaust (not shown). The smaller hollow shaft 15 is thus either form as a separate accessory for assembly/attachment to a vacuum cleaner exhaust tube (not shown) or may be formed an integral part of the vacuum cleaner tube exhaust. It will be noted that the smaller hollow shaft 15 has an inner end 23 that terminates short of the other open end 13 of the hollow cylindrical section 9, for purposes to be described below.

Figure 2:
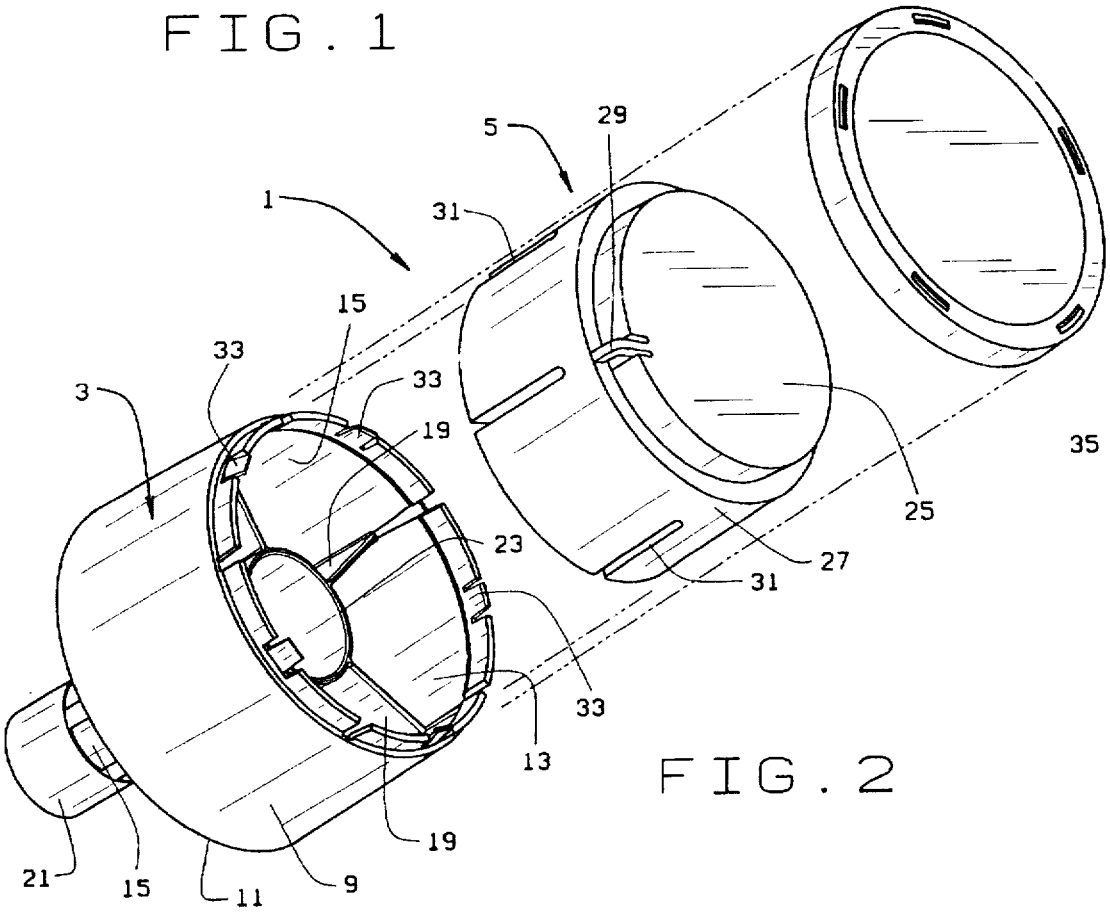
FIG. 2 is an exploded perspective view of the various elements forming the improved muffler of the present invention.
Figure 3:
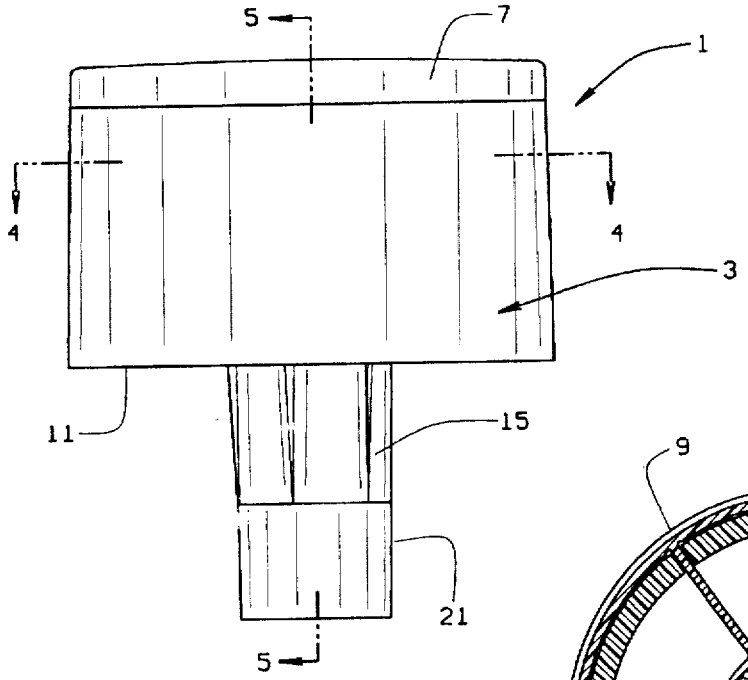
FIG. 3 is a side elevational view of the improved muffler.
Figure 6:
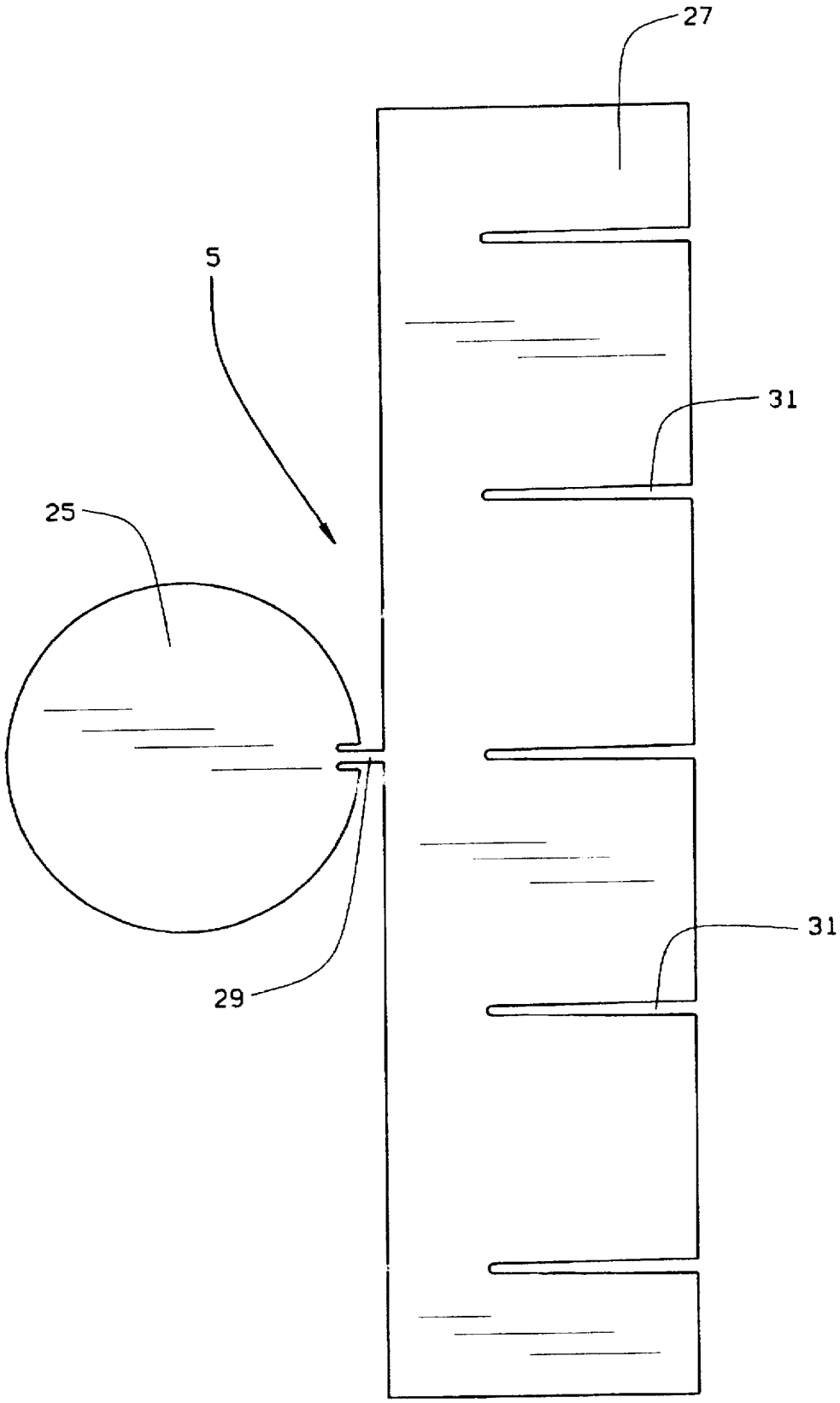
FIG. 6 is a top plan view of the noise dampening element incorporated in the improved muffler of the present invention.

The noise dampening element 5 is initially constructed in a flattened shape as illustrated in FIG. 6 of the drawings from a foam plastic material, open cell polyester, polyurethane foam material being one preferred example. The noise dampening element 5 includes a disk section 25 and a rectangularly shaped section 27 which are integrally connected to one another at 29. The rectangular section 27 also includes a series of 5 slits 31 extending from one side edge. From the flattened condition shown in FIG. 6 of the drawings, the noise dampening element 5 is reconfigured to that illustrated in FIG. 2 of the drawings such that it can be assembled within the open end 13 of the hollow cylindrical section 9 forming the muffler body 3. Each of the slits 31 in the rectangularly shaped section 27 of the noise dampening element 5 receive one of the radially extending fms 19 in order to enable the noise dampening element 5 to have its disk section 25 extend across the open upper end 13 while also extending along an inner circumferential wall 15 of the hollow cylindrical section 9.

Once the noise dampening element 5 is positioned within the muffler body 3, the separate cover 7 is attached to the muffler body 3. For this purpose, the muffler body includes a series of spaced longitudinally extending and radially deflectable fastening tabs 33 which releasably engage slots 33 in the separate cover 7. In this way, the separate cover 7 is releasably attached to the muffler body, while holding the noise dampening element 5 within the muffler body.

Figure 5:
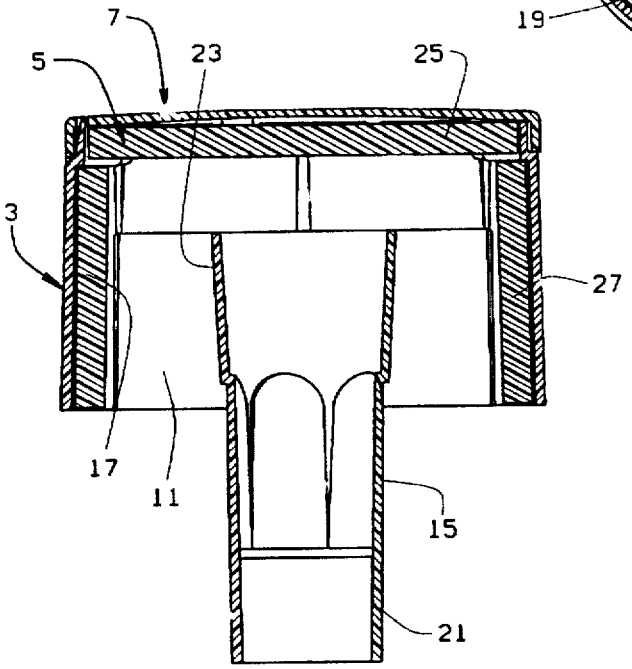
FIG. 5 is a sectional view of the improved muffler as viewed along lines 5—5 of FIG. 3.

As illustrated in FIGS. 4–5 of the drawings, the noise dampening element 5 extends across the open upper end 13 of the hollow cylindrical body 9 beneath the separate cover 7 which serves as a transverse end wall for the muffler body 3. In an alternative embodiment, the separate cover 7 may be formed integrally with the muffler body 3, thus serving as an integral transverse end wall. In either instance, the disk shaped section 25 of the noise dampening element 5 extends across the inner end 23 of the smaller hollow shaft 15, the inner end 23 of the hollow shaft 15 being spaced from the disk section 25 of the noise dampening element 5, as illustrated in FIG. 5 of the drawings.

The improved muffler 1 functions in the following described manner: Noise transmitted from the vacuum cleaner exhaust (not shown) passes through the smaller hollow shaft 15 into the muffler body for absorption by the noise dampening element 5 prior to being diverted by the transverse end wall or separate cover 7 in an opposite direction through the open end 11 of the muffler body 3. Thus, the vacuum exhaust air and noise, after being absorbed or dampened by the noise dampening element 5 is turned or diverted by the transverse end wall or separate cover 7 in a 180° reverse path for exhaust through the open end 11 of the muffler body 3. A substantial portion of the noise and vacuum exhaust air is not reflected or diverted in the 180° turn, but rather is absorbed by the noise dampening element 5, including the disk section 25. In this regard, it will be noted that the disk section 25 is directly exposed to exhaust air discharged past the open inner end 23 of the smaller hollow shaft 15, as well as to the rectangular noise dampening section 27 that is mounted against the inner circumferential wall 15 of the muffler body 3.

Noise tests that were conducted both with and without the improved muffler of the present invention demonstrated a substantial, perhaps even a dramatic decrease in noise levels. With a hose attached to a wet/dry vacuum cleaner, it was discovered that the noise level without an improved muffler was measured at 86.96 decibels, while the noise level measured with the improved muffler of the present invention produced 80.84 decibels. This resulted in a change of 6.12 decibels or an improvement of 7%. With a blocked hose, the noise level without a muffler measured 97.93 decibels, while the noise level with the improved muffler of the present invention measured 88.06 decibels. The decibel change was thus 9.87 decibels or an improvement of 10%. Each change of 3 decibels results in a 50% improvement in noise power level. Thus, for the decibel change of 6.12 decibels for the nonblocked hose, the improvement in noise power level was approximately 75%, while the improvement with the blocked hose resulted in noise power level improvements of approximately 87.5%. The tests described above are to be considered in an exemplary not limiting sense.

This substantial improvement in noise level was obtained without any measurable decrease in the vacuum cleaner's performance or efficiency. In fact, air flow testing both with and without the improved muffler of the present invention showed no measurable difference in the vacuum cleaner's performance or efficiency. There may even be some slight measurable improvement in the vacuum cleaner's performance and efficiency based on air flow testing, but at a very minimum, there was no measurable difference in the vacuum cleaner's performance and efficiency.

From the foregoing, it will now be appreciated that the improved muffler of the present invention, while having a relatively simple construction that is made of a minimum number of parts nonetheless substantially decreases the noise level emanating from a vacuum cleaner exhaust, with a resulting increase in the user's comfort level. At the same time, the improved muffler does not measurably decrease the vacuum cleaner's performance or efficiency while providing the aforementioned reduction in noise levels. When used as either a separate accessory or as an integral part of a vacuum cleaner, the improved muffler of the present invention lends itself for use with a variety of vacuum cleaners of different size and function. As also previously indicated, the muffler can be used for other product applications, as well.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. An improved muffler comprising:

a muffler body with a transverse end wall at one end and an opposite open end, said muffler body being connected to an inner end of a smaller hollow shaft which extends within the open end of the muffler body and terminates short of the transverse end wall, said smaller hollow shaft having an outer end which extends outside of the muffler body for attachment to a vacuum cleaner exhaust; and a noise dampening element positioned within the muffler body adjacent the transverse end wall;

whereby noise transmitted from the vacuum cleaner exhaust passes through the smaller hollow shaft into the muffler body for absorption by the noise dampening element prior to being diverted by the transverse end wall in an opposite direction through the open end of the muffler body.

2. The improved muffler as defined in claim 1 in which the smaller hollow shaft is integrally connected to the muffler body through interconnecting radially extending fins.

3. The improved muffler as defined in claim 1 in which the transverse end wall is a separate cover that is releasably attached to the muffler body.

4. The improved muffler as defined in claim 3 in which the noise dampening element is trapped between the separate cover and the muffler body.

5. The improved muffler as defined in claim 1 in which the noise dampening element extends both adjacent the transverse end wall and along an inner circumferential wall of the muffler body.

6. The improved muffler as defined in claim 5 in which the transverse end wall is a separate cover that traps the noise dampening element relative to the muffler body.

7. The improved muffler as defined in claim 6 in which the noise dampening element that extends along an inner circumferential wall of the muffler body includes slits for receiving radially extending fins integrally interconnecting the smaller hollow shaft to the muffler body.

8. The improved muffler as defined in claim 7 in which the noise dampening element is a foam plastic material.

9. The improved muffler as defined in claim 8 in which the foam plastic material is an open cell polyester polyurethane foam material.

10. The improved muffler as defined in claim 7 in which the noise dampening element adjacent the transverse end wall and inner circumferential wall are interconnected as a one piece element.

11. An improved muffler comprising:

a muffler body having a hollow cylindrical section with opposite open ends, said muffler body being integrally connected to an inner end of a smaller hollow shaft which extends into one open end of the muffler body and terminates short of the other open end, said smaller hollow shaft being connected to the hollow cylindrical section by radially extending fins extending between the smaller hollow shaft and the hollow cylindrical section, said smaller hollow shaft having an outer end which extends outside of the muffler body for attachment to a vacuum cleaner element;

a noise dampening element positioned in the muffler body adjacent the opposite open end of the hollow cylindrical section that is spaced from the smaller hollow shaft; and a separate cover for covering the noise dampening element, said separate cover being attached to the hollow cylindrical section, whereby noise transmitted from the vacuum cleaner exhaust passes through the smaller hollow shaft into the hollow cylindrical section for absorption by the noise dampening element prior to being diverted by the separate cover in an opposite direction through the open end of the hollow cylindrical section.

12. The improved muffler as defined in claim 11 in which the separate cover and hollow cylindrical element at one open end include complementary fastening elements for releasably securing same together.

13. The improved muffler as defined in claim 11 in which the noise dampening element also extends along an inner wall of the hollow cylindrical section.

14. The improved muffler as defined in claim 13 in which the noise dampening element that extends along the inner wall of the hollow cylindrical section includes slits for receiving the radially extending fins interconnecting the smaller hollow shaft to the hollow cylindrical section.

15. The improved muffler as defined in claim 13 in which the noise dampening element is an open cell polyester polyurethane foam material.

* * * * *